United States Patent [19]

Carle

[11] 4,052,790

[45] Oct. 11, 1977

[54] PEA AND BEAN CUTTER

[76] Inventor: Albert S. Carle, R.R. 2, Box 129 E 2, Lake City, Fla. 32055

[21] Appl. No.: 711,309

[22] Filed: Aug. 3, 1976

[51] Int. Cl.[2] ..... B26B 29/00

[52] U.S. Cl. ..... 30/287; 30/90.4; 30/290

[58] Field of Search ..... 30/294, DIG. 3, 90.4, 30/287, 290

[56] References Cited

U.S. PATENT DOCUMENTS

| | | | |
|---|---|---|---|
| 1,739,972 | 12/1929 | Klinger | 30/90.4 |
| 2,235,342 | 3/1941 | Turner | 30/294 |
| 2,463,990 | 3/1949 | McGonigal | 30/290 |
| 2,621,659 | 12/1952 | Greene | 30/90.4 X |
| 2,731,970 | 1/1956 | Hughes | 30/90.4 X |
| 3,238,618 | 3/1966 | Cook | 30/90.4 |
| 3,621,574 | 11/1971 | Yanke et al. | 30/290 |

*Primary Examiner*—Gary L. Smith
*Assistant Examiner*—J. T. Zatarga
*Attorney, Agent, or Firm*—Allen D. Brufsky

[57] ABSTRACT

A pea and bean cutter has a semicircular slot with a cutting blade protruding part way into the semicircle. A pea or bean pod moved longitudinally through the slot has its skin longitudinally sliced without marring the peas or beans within.

5 Claims, 3 Drawing Figures

FIG.1
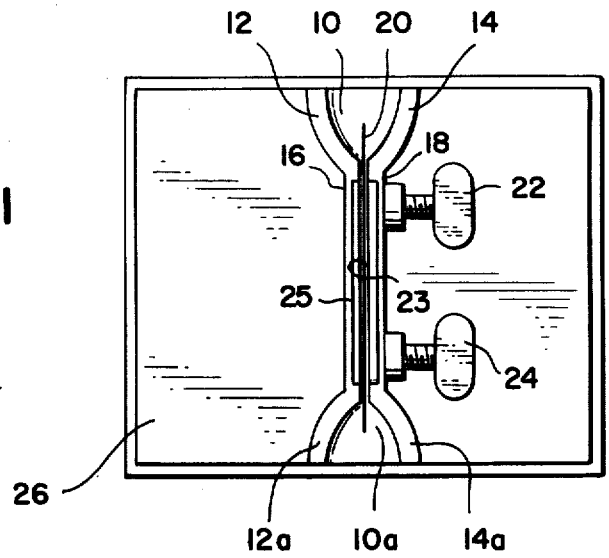
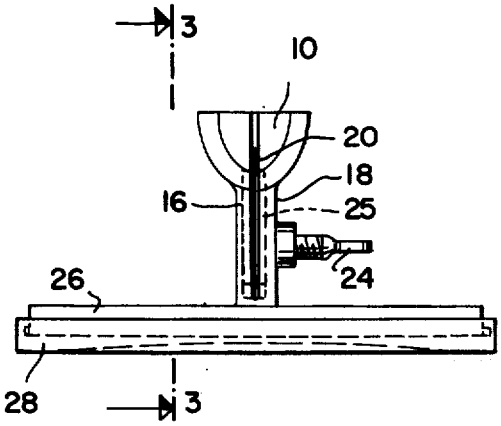
FIG.2
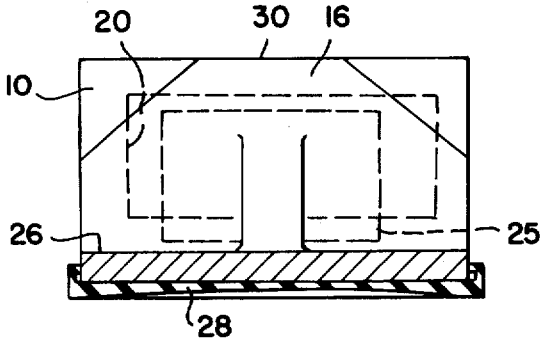
FIG.3

PEA AND BEAN CUTTER

BACKGROUND OF THE INVENTION

The shelling of peas and beans is a time consuming operation. In the usual kitchen situation, it is desired to extract the beans or peas whole from the pod without cutting or mashing them. The prior art teaches numerous devices for slicing beans and peas lengthwise and crosswise, see for example, U.S. Pat. Nos. 2,288,639, 1,803,880, 1,795,231 and 2,010,22. The prior art does not teach a device for slitting the pod without damaging the beans or peas within.

SUMMARY OF THE INVENTION

The present invention teaches a utensil for slitting the pod of a pea or bean and enabling the undamaged removal of the vegetables within. A semicircular slot in the edge of the device is shaped to fit a bean or pea pod. A cutting blade protrudes partway into the semicircular slot. When a bean or pea pod is fitted into the slot and drawn lengthwise therethrough, the cutting blade makes a lengthwise incision to the depth allowed by the amount of the blade allowed to protrude into the slot. The amount of blade protrusion is adjustable to adapt the utensil to use on vegetables having thin or thick skin.

One embodiment of the invention has a nonskid base attached thereto for use on a working surface such as a kitchen counter. Hand-held embodiments of the utensil should be understood to be equally encompassed within the scope of the invention.

BRIEF DESCRIPTION OF THE DRAWINGS

FIG. 1 shows a top view of one embodiment of the invention.

FIG. 2 shows an end view of the embodiment.

FIG. 3 shows a cross section taken along 3—3 in FIG. 2.

DETAILED DESCRIPTION OF THE PREFERRED EMBODIMENT

Referring to FIG. 1, a semicircular slot 10 or trough in one end of the utensil is defined by outward bowing regions 12, 14 in side plates 16, 18. A thin blade 20 protrudes part way into the semicircular slot 10. A parallel slot 23 between said side plates 16, 18 contains a blade holder 25. Thumb screws 22 and 24, threadably engaged in side plate 18, apply mechanical pressure to the blade holder 25 to hold the blade 20 at the selected protrusion. By loosening the thumb screws 22 and 24, the protrusion can be adjusted as desired to suit the vegetables being prepared.

A second semicircular slot 10*a* may optionally be formed by bowing side regions 12*a,* 14*a* in the opposite end of the side plates 16, 18.

The side plates 16, 18 are supported on a base 26 in the embodiment illustrated in the drawing but may optionally be hand held.

Referring now to FIG. 2, the semicircular slot 10 with the protruding blade 20 is seen. The side plates 16, 18 are attached by suitable means to the base 26. The bottom surface of the base may be coated with a non-skid material 28 such as rubber to facilitate use of the utensil on a working surface.

Referring to FIG. 3, the semicircular slot 10 is shown at a diagonal at the corner of the side plates 16, 18 (hidden behind 16). Other arrangements are foreseen, such as a single trough-shaped slot along the entire upper edge 30 of the side plates 16, 30. The blade holder 25 carrying the blade 20 is adapted to adjustment upward and downward as indicated by the arrows.

It will be understood that the claims are intended to cover all changes and modifications of the preferred embodiments of the invention, herein chosen for the purpose of illustration which do not constitute departures from the spirit and scope of the invention.

What is claimed is:

1. A vegetable preparing utensil having side plates comprising:

a. a pair of troughs in said side plates defined by outward bowing regions disposed at an angle to a horizonal plane at opposite ends of said side plates adapted to the lengthwise fitting therein of a vegetable;

b. a cutting blade having a cutting edge at each end protruding part way into each of said troughs;

c. means for adjusting the amount of protrusion of said cutting edges into each of said troughs; and d. means for holding said cutting edges in an adjusted position.

2. A utensil as recited in claim 1, wherein said means for adjusting comprises;

a parallel slot between said side plates;

a blade holder fitted within said parallel slot; and said blade holder being adapted to translation within said parallel slot.

3. The utensil recited in claim 1, wherein said means for holding comprises at least one screw adapted to applying pressure on said means for holding.

4. The utensil recited in claim 1, wherein said utensil includes a mounting base.

5. The utensil recited in claim 4, further comprising a non-skid material on at least a portion of one surface of said base.

* * * * *